US006206278B1

(12) United States Patent
Cornell et al.

(10) Patent No.: US 6,206,278 B1
(45) Date of Patent: Mar. 27, 2001

(54) FLUID DISPENSING SPOUT FOR BEVERAGE CONTAINERS

(75) Inventors: Stephen W. Cornell, Naperville, IL (US); Peter F. Murphy, Grosse Pointe, MI (US); Jeff T. Debord, Worthington, OH (US); Gregg M. Davis, Powell, OH (US); Jay F. Perkins, Pickerington, OH (US)

(73) Assignee: The PopStraw Company, LLC, Roseville, MI (US)

( * ) Notice: Subject to any disclaimer, the term of this patent is extended or adjusted under 35 U.S.C. 154(b) by 0 days.

(21) Appl. No.: 09/502,842

(22) Filed: Feb. 11, 2000

Related U.S. Application Data

(62) Division of application No. 09/102,385, filed on Jun. 22, 1998, now Pat. No. 6,076,729.

(51) Int. Cl.[7] ..... B65D 5/72; B65D 77/28

(52) U.S. Cl. ..... 229/103.1; 220/706; 220/707; 220/708; 229/160.2

(58) Field of Search ..... 229/103.1, 125.42, 229/160.2; 220/705–710; 215/388, 389; 222/464.1, 464.3, 464.6, 529, 530, 538, 539

(56) References Cited

U.S. PATENT DOCUMENTS

| | | |
|---|---|---|
| 2,069,738 | 2/1937 | Buchen . |
| 2,323,447 | 7/1943 | Chase . |
| 2,324,807 | 7/1943 | Wentz . |
| 2,392,479 | 1/1946 | Humbert . |
| 2,450,244 | 9/1948 | Lynch . |
| 2,547,362 | 4/1951 | Berry . |
| 2,724,536 | 11/1955 | Pugh, Sr. . |
| 2,773,632 | 12/1956 | Dobbins, III . |
| 2,799,439 | 7/1957 | Pugh, Sr. . |
| 2,949,217 | 8/1960 | Pugh, Sr. . |
| 2,992,118 | 7/1961 | Daline . |
| 3,071,303 | 1/1963 | Pugh . |
| 3,194,470 | 7/1965 | Zimmerman et al. . |
| 3,215,329 | 11/1965 | Pugh, Sr. . |
| 3,240,415 | 3/1966 | Pugh, Sr. . |
| 3,259,297 | 7/1966 | Kalajian . |
| 3,268,792 | 8/1966 | Barmherzig . |
| 3,291,331 | 12/1966 | Grisham et al. . |
| 3,303,984 | 2/1967 | Jurena . |
| 3,303,985 | 2/1967 | Prokes et al. . |
| 3,325,076 | 6/1967 | Soucy . |
| 3,462,061 | 8/1969 | Shore . |
| 3,486,679 | 12/1969 | Pfahler . |
| 3,520,464 * | 7/1970 | Pugh, Sr. ..... 229/160.2 |
| 3,542,278 | 11/1970 | Deaver . |
| 3,623,632 | 11/1971 | Chang . |
| 3,717,476 | 2/1973 | Harvey . |
| 3,792,798 | 2/1974 | Chang . |
| 3,874,554 | 4/1975 | Chang . |
| 4,194,674 | 3/1980 | Pearson . |

(List continued on next page.)

FOREIGN PATENT DOCUMENTS

| | | |
|---|---|---|
| 87-186965/27 | 11/1985 | (FR) . |
| WO 85/04850 | 11/1985 | (WO) . |

*Primary Examiner*—Gary E. Elkins
(74) *Attorney, Agent, or Firm*—Harness, Dickey & Pierce, P.L.C.

(57) ABSTRACT

The present invention includes a conduit assembly having a fitment adapted to be sealingly coupled to a container, a closure mechanism, and a conduit operably coupled to the closure mechanism. The fitment includes a fitment passage and the closure mechanism is movable between a sealed position engaging the fitment to seal the fitment passage and an open position. The conduit is coupled to the closure mechanism for movement between a stored position and an operative position wherein the conduit is moved from the stored position toward the operative position when the closure mechanism is moved into its open position.

11 Claims, 14 Drawing Sheets

U.S. PATENT DOCUMENTS

| | | | | |
|---|---|---|---|---|
| 4,228,913 | | 10/1980 | Mack et al. . | |
| 4,251,019 | | 2/1981 | Cone . | |
| 4,407,425 | | 10/1983 | Combs . | |
| 4,448,316 | | 5/1984 | Hiroshige . | |
| 4,560,081 | | 12/1985 | Adams . | |
| 4,561,557 | | 12/1985 | Park et al. . | |
| 4,718,778 | | 1/1988 | Ichikawa . | |
| 4,726,491 | | 2/1988 | Moon . | |
| 4,733,785 | | 3/1988 | Turner, Jr. et al. . | |
| 4,792,083 | | 12/1988 | Yassur . | |
| 4,830,273 | | 5/1989 | Kalberer et al. . | |
| 4,930,652 | | 6/1990 | Murphy et al. . | |
| 4,964,562 | | 10/1990 | Gordon . | |
| 4,997,112 | | 3/1991 | Eichler . | |
| 5,000,337 | | 3/1991 | Im . | |
| 5,029,752 | * | 7/1991 | Andersson | 229/160.2 |
| 5,060,804 | | 10/1991 | Beales et al. . | |
| 5,065,938 | | 11/1991 | Anderson . | |
| 5,148,971 | | 9/1992 | Ahn . | |
| 5,188,283 | | 2/1993 | Gu . | |
| 5,199,635 | | 4/1993 | Abrams et al. . | |
| 5,253,779 | | 10/1993 | Lee . | |
| 5,372,300 | | 12/1994 | Nedstedt . | |
| 5,427,310 | | 6/1995 | Testa, Jr. . | |
| 5,482,202 | | 1/1996 | Wen . | |
| 5,509,585 | | 4/1996 | Mock et al. . | |
| 5,687,872 | * | 11/1997 | Nmngani | 229/103.1 |
| 5,823,422 | * | 10/1998 | Collier et al. | 229/103.1 |
| 5,871,146 | * | 2/1999 | Onderko et al. | 229/160.2 |
| 6,076,729 | * | 6/2000 | Cornell et al. | 229/103.1 |

* cited by examiner

FLUID DISPENSING SPOUT FOR BEVERAGE CONTAINERS

This application is a division of U.S. patent application Ser. No. 09/102,385, filed Jun. 22, 1998, U.S. Pat. No. 6,076,729.

FIELD OF THE INVENTION

The present invention relates to containers and, more particularly, to a container having a dispensing conduit.

BACKGROUND OF THE INVENTION

In the prior art containers for holding a liquid are known to include a dispensing conduit such as a straw or spout for facilitating the withdrawal of the liquid from the container. Various arrangements have been used for coupling the conduit to the container in a stored position so that the conduit is readily available for use by a consumer. Other prior art containers include conduits that are adapted for automatic or manual movement from the stored position to an operative position. Unfortunately, the prior art has not adequately addressed the need for an efficient yet inexpensive conduit assembly for use with a sealed liquid container. More particularly, prior art containers fail to provide a conduit assembly that is simple to manufacture and contain within the container, that effectively allows for sealing the container in a stored position, and that facilitates positioning the conduit in an operative position to remove fluid from the container.

SUMMARY OF THE INVENTION

Accordingly, a need exists for a container having a conduit assembly that maintains its sealed position during storage while simply and efficiently moving the conduit into its operative position when desired. To address this need, the present invention includes a conduit assembly having a fitment adapted to be sealingly coupled to a container, a closure mechanism, and a conduit operably associated with the closure mechanism. The fitment includes a fitment passage and the closure mechanism is movable between a sealed position engaging the fitment to seal the fitment passage and an open position. The conduit is operably associated with the closure mechanism for movement between a stored position and an operative position wherein the conduit is moved from the stored position toward the operative position when the closure mechanism is moved into its open position.

BRIEF DESCRIPTION OF THE DRAWINGS

The objects and features of this invention will become further apparent from a reading of the following detailed description taken in conjunction with the drawings, in which.

DETAILED DESCRIPTION OF THE PREFERRED EMBODIMENT

Figure 1:
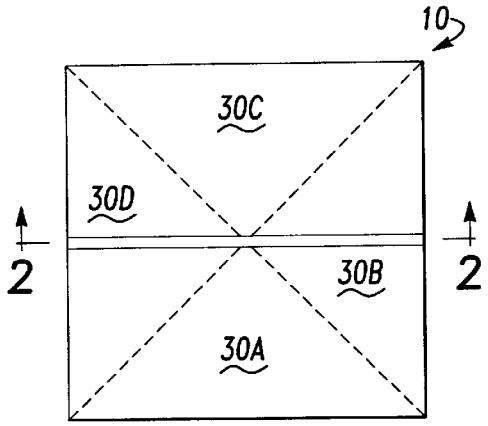
FIG. 1 is top plan view of a container according to the present invention.
Figure 2:
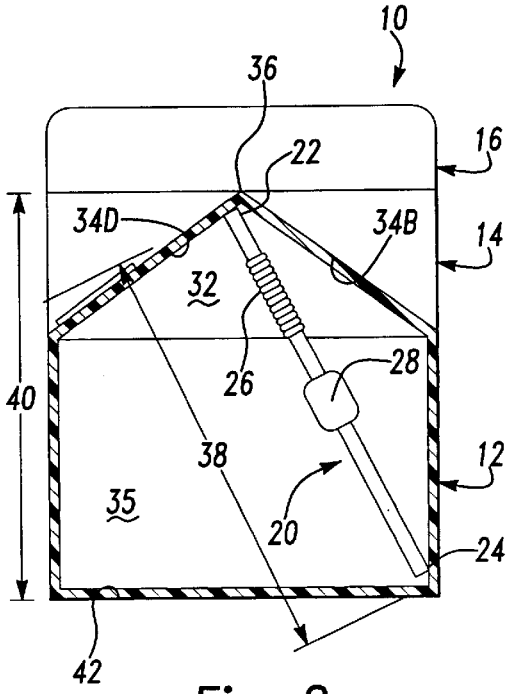
FIG. 2 is sectional view of the container illustrated in FIG. 1 taken along the line 2—2.
Figure 3:
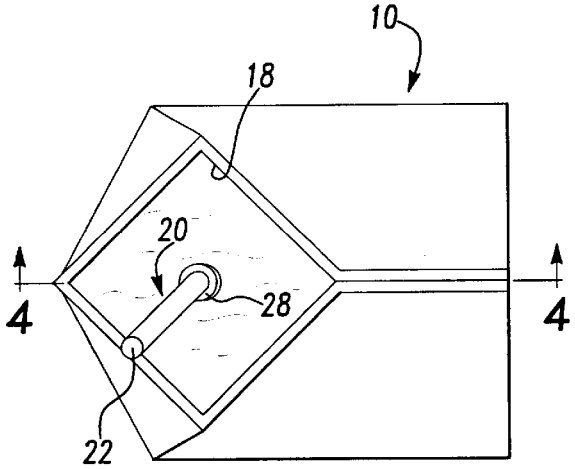
FIG. 3 is a top plan view of the container shown in FIG. 1 in an open condition.
Figure 4:
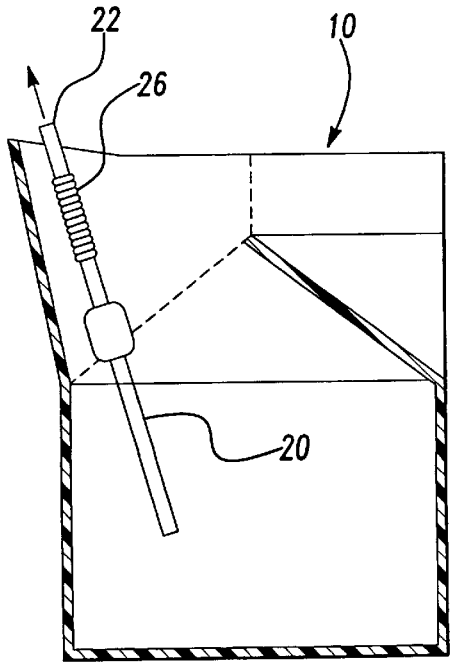
FIG. 4 is a sectional view of the container illustrated in FIG. 3 taken along the line 4—4.

With reference to FIGS. 1–4, a container 10 is shown to include a generally rectangular lower portion 12 and a gable shaped top 14 (FIG. 2). A crest section 16 is formed at the top of the container to seal container 10 in a manner generally recognized in the art. In the illustrated embodiment, container 10 is a carton that may be opened in a conventional manner to form the generally diamond shaped opening 18 illustrated in FIG. 3. Container 10 incorporates evidence of being previously opened or being tampered with due to the requirement of separating crest section 16 formed at the top of container 10.

In the present invention, a conduit 20 is disposed within container 10 prior to the sealing thereof. The conduit includes a first end 22, a second end 24, and a flexible and extendable corrugated segment 26 disposed therebetween. A float 28 is coupled to conduit 20 in order to provide buoyancy. It should be appreciated that the term conduit is used throughout this application to encompass any member that defines a channel or tube for conveying a fluid. Accordingly, while the embodiments of the invention illustrated and described herein include straws and spouts, other conduits may be used without departing from the proper scope of the invention as defined by the appended claims.

When container 10 is in its unopened configuration as illustrated in FIG. 1, gable top 14 includes four planar and triangular shaped sections 30A, 30B, 30C and 30D which form the gabled cavity 32 (FIG. 2) within container 10. The inner surfaces of the planar sections 30A–D, e.g. 34B and 34D of the corresponding planar container members 30B and 30D, direct the conduit 20, under the buoyant force generated by float 28, toward an apex 36 of cavity 32. When container 10 is opened in the conventional manner, the buoyant force of float 28 urges first end 22 of conduit 20 through opening 18. To ensure the proper positioning of conduit 20 within container 10, conduit 20 is formed such that the retracted length 38 thereof is greater than the height 40 of the gabled cavity 32 measured from lower container surface 42 to apex 36.

Corrugated segment 26 of conduit 20 is extendable by the consumer and manipulatable to locate first end 22 of conduit 20 in the desired position for removal of the fluid contained within a chamber 35 formed by container 10. Those skilled in the art will appreciate that the embodiment of the present invention illustrated in FIGS. 1–4 provides a simple apparatus for urging the straw from its stored position within chamber 35 to its extended or operative position illustrated in FIG. 4.

Figure 5:
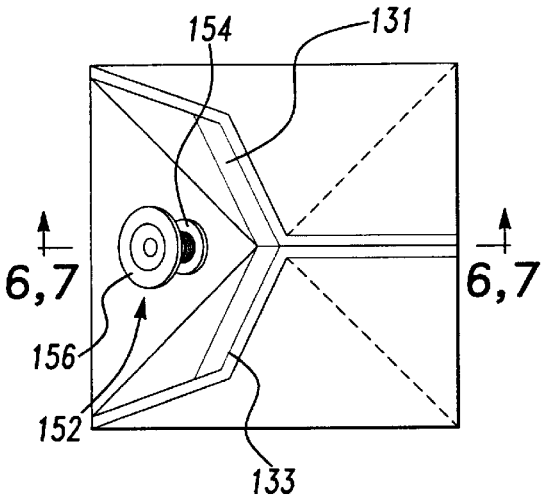
FIG. 5 is a top plan view of a container according to another embodiment of the present invention in a partially open condition.
Figure 6:
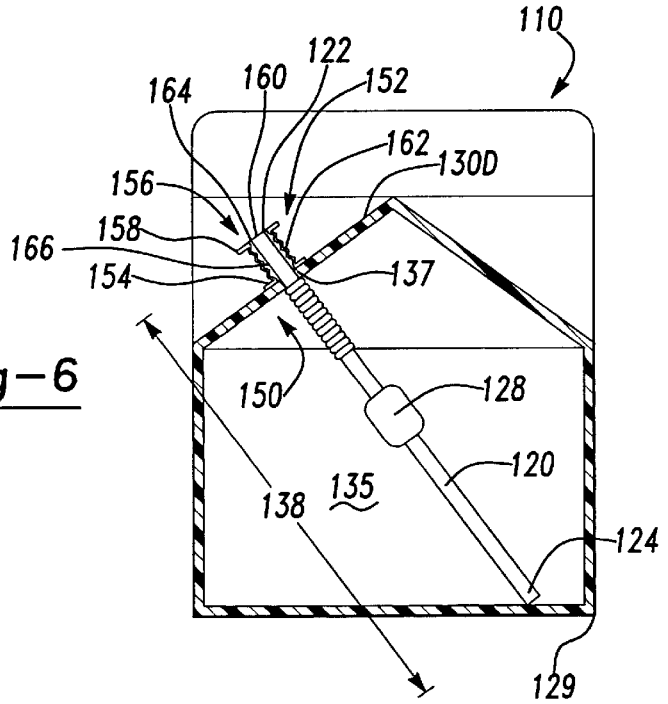
FIG. 6 is a sectional view of the container illustrated in FIG. 5 in its fully closed position taken along the line 6—6.
Figure 7:
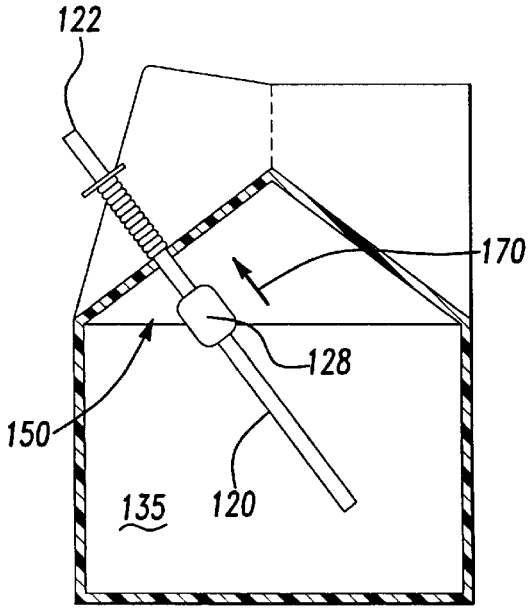
FIG. 7 is a cross-sectional view of the container illustrated in FIG. 5 in its fully open position taken along the line 7—7.

Turning to another embodiment of the present invention, a container 110 is illustrated in FIGS. 5–7 to include a conduit assembly 150 having a conduit 120, a plunger 152 and a fitment 154. Plunger 152 is coupled to the container by fitment 154 in a manner generally known in the art such as through sonic welding. While conduit assembly 150 is illustrated in FIGS. 5–7 as being coupled to an inclined surface 130D of container 110, those skilled in the art will appreciate that the conduit assembly may be coupled to a variety of containers in numerous locations without departing from the scope of the invention as defined by the appended claims.

When container 110 is in its closed position illustrated in FIG. 6, access to plunger 152 is limited by flaps 131 and 133 (FIG. 5). A user can acquire access to conduit assembly 150 by separating flaps 131 and 133 in a conventional manner. After separating flaps 131 and 133 as illustrated in FIG. 5, the user can manipulate plunger 152 to cause the presentation of conduit 120 from its stored position within a container chamber 135 (FIG. 6) to its operative position (FIG. 7).

Fitment 154 couples plunger 152 to container 110 and sealably covers an orifice 137 formed in container 110. As best illustrated in FIG. 6, plunger 152 includes a head 156 that defines a flange 158, a passage 160 and a collapsible sleeve 162 movably coupling head 156 to fitment 154. A seal membrane 164 covers passage 160 to isolate the contents of container 110 from the surrounding environment when the conduit and plunger are in their sealed or stored positions illustrated in FIG. 6.

In the sealed position, conduit 120 is disposed within container chamber 135 with a first conduit end 122 protruding from container orifice 137 and into a collapsible cavity 166 formed by plunger 152. It will be appreciated by those skilled in the art that a float 128 urges conduit 120 in an upward direction until first conduit end 122 is in contacting engagement with head 156 or seal 164. In this position, the first conduit end 122 aligns with passage 160 in head 156. Conduit 120 has a retracted length 138 such that, in this stored position, a second conduit end 124 is proximate to a corner 129 of container 110. Those skilled in the art will appreciate that in the stored position illustrated in FIG. 6, conduit assembly 150 isolates the liquid from the environment surrounding container 110. Moreover, conduit 120 is maintained within container chamber 135 in a secure position that may be readily accessed by a consumer.

As illustrated in FIGS. 5 and 7, the consumer can access the fluid contained within chamber 135 through manipulation of plunger 152. More particularly, after the consumer separates flaps 131 and 133 as generally described above, the consumer obtains access to the fluid within chamber 135 by displacing plunger head 156 toward fitment 154. Flange 158 facilitates the displacing of plunger head 156. Movement of plunger head 156 displaces second conduit end 124 into engagement with comer 129. Further movement of head 156 urges first conduit end 122 through seal membrane 164 covering passage 160 (FIG. 7). Conduit 120 pierces seal membrane 164 and is urged in the direction indicated by arrow 170 through the buoyant force of float 128. In the preferred embodiment, float 128 prevents the complete removal of conduit 120 from container 110 while first conduit end 122 is extendable away from the container by axial elongation of the corrugated segment 126. The piercing of seal membrane 164 by conduit 120 provides evidence that container 110 has been opened thus providing evidence of tampering.

Those skilled in the art will appreciate that the embodiment of the present invention illustrated in FIGS. 5–7 provides a unique apparatus for storing and accessing a conduit for extracting liquid from a sealed container. The invention effectively maintains the container in a sealed position during storage while providing easy access to the liquid when desired. The user may have access to the conduit through simple manipulation of a device that may be easily and efficiently connected to the container during the manufacturing process. As a result, the present invention advantageously simplifies the manufacture and operation of an effective device for these purposes.

Turning now to the embodiment of the present invention illustrated in FIGS. 8A, 8B, 9, and 10, an alternate conduit assembly 250 is coupled to a container 210. Conduit assembly 250 includes a closure assembly 252 and a sleeve-like fitment 254 coupled to a wall 217 of container 210. Fitment 254 illustrated in FIGS. 8A and 8B includes a flange portion 255 integral with a sleeve 257 that extends through an orifice 237 formed in container wall 217. Sleeve 257 has an inner surface 259 that defines a fitment opening 263 (FIG. 9) that extends from flange 255 to a terminal end 261 of sleeve 257.

A cover 258 is connectable to sleeve 257 to seal the contents of container chamber 235 from the environment surrounding the container. Cover 258 includes a tether strap 260 that connects cover 258 to conduit 220 when conduit 220 is in the stored position illustrated in FIGS. 8A and 8B. To facilitate a secure connection of conduit 220 to cover 258, conduit 220 is bent at a corrugated segment 226 thereof and tether strap 260 is coupled to segment 226 to secure conduit 220 to cover 258.

Figure 8A:
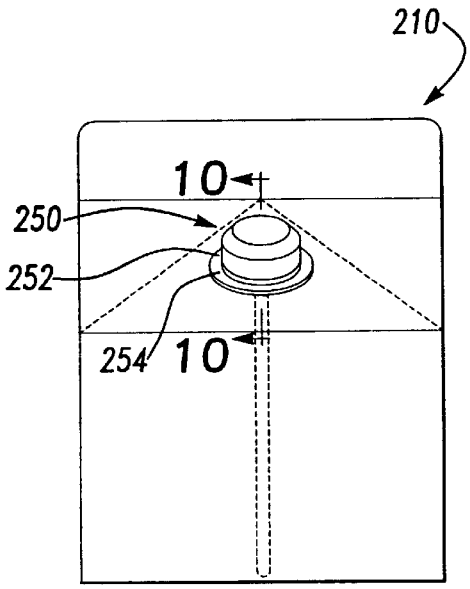
FIG. 8A is a front elevational view of a container according to another embodiment of the present invention.
Figure 8B:
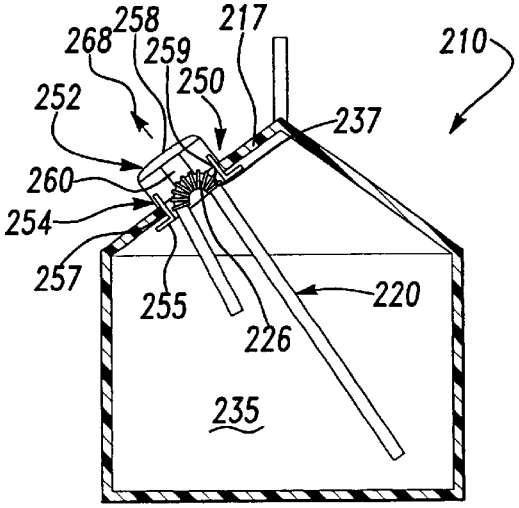
FIG. 8B is a side elevational view of the container illustrated in FIG. 8A with portions thereof removed for clarity.
Figure 9:
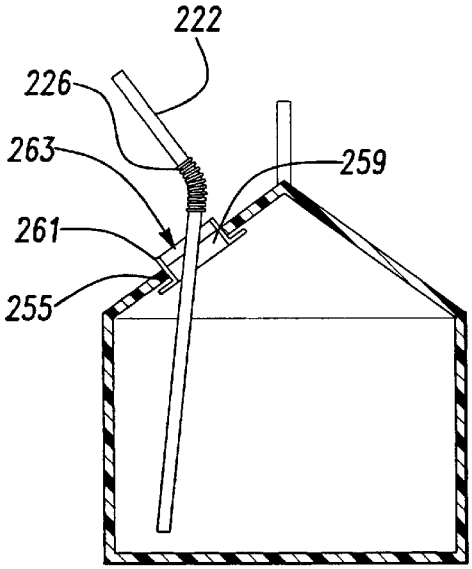
FIG. 9 is a side elevational view similar to that shown in FIG. 8B with the conduit in its operative position.

Those skilled in the art will appreciate that cover 258 is releasably secured to fitment 254 for movement from the sealed position illustrated in FIGS. 8A and 8B to the removed position illustrated in FIG. 9. More particularly, the user may grasp cover 258 such as at a conventional handle or tab 265 affixed thereto (FIG. 10) and displace cover 258 relative to fitment 254 in the direction indicated by arrow 268 (FIG. 8B). After cover 258 is displaced a sufficient distance, a first conduit end 222 extends beyond terminal end 261 (FIG. 9) of fitment sleeve 257 and the resiliency of corrugated segment 226 tends to straighten conduit 220 in the manner illustrated in FIG. 9. In this operative position, the liquid within a chamber 235 may be removed through conduit 220. Those skilled in the art will appreciate that while a specific cover 258 having tether 260 has been described herein with reference to FIGS. 8A–10, conduit 220 may also be attached to cover 258 or tether strap 260 by coupling engagement with first end 222 of conduit 220. The coupling engagement may include a post such as that indicated by reference numeral 360 in FIGS. 11–14.

The present invention also advantageously allows the re-sealing of container 210. To effect resealing, conduit 220 is removable from fitment opening 263, tether strap 260 is disengaged from conduit 220 by sliding cover 258 axially along the conduit and over first end 222 thereof, and cover 258 is replaced into sealing engagement with fitment 254 as shown in FIG. 8A.

Figure 10:
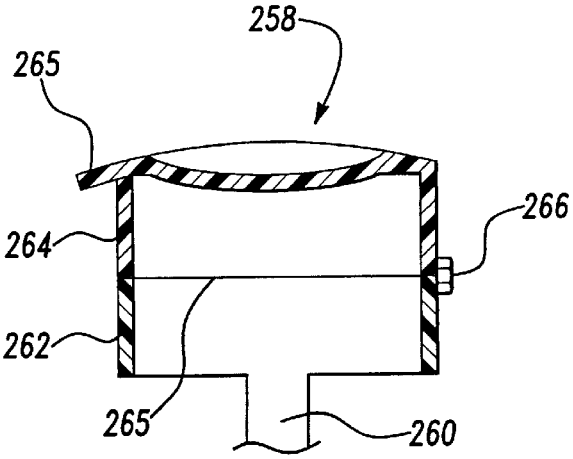
FIG. 10 is a cross-sectional view of a portion of the container illustrated in FIG. 8A taken along the line 10—10.

As best illustrated in FIG. 10, cover 258 preferably includes a first segment 262 integral with tether strap 260 and a second segment 264 pivotably attached to first segment 262 such as at a hinge 266 (FIG. 8). This cover configuration allows the user to pivotably displace second segment 264 relative to first segment 262 after resealing of the container in which position first segment 262 acts as a pour spout for pourably dispensing fluid from the container 210. The attachment between segments 264 and 262 can be a scored line 265 which when separated will provide evidence of previously being opened and/or tampered with. Other means for providing tamper evidence include adhesive tape or other methods known well in the art.

Figure 11:
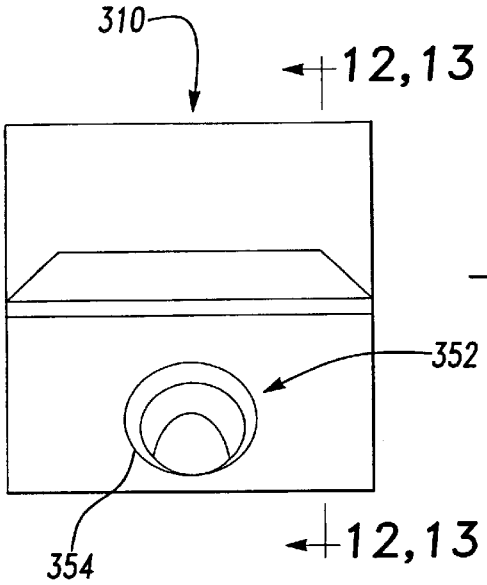
FIG. 11 is a top plan view of a container according to another embodiment of the present invention.
Figure 12:
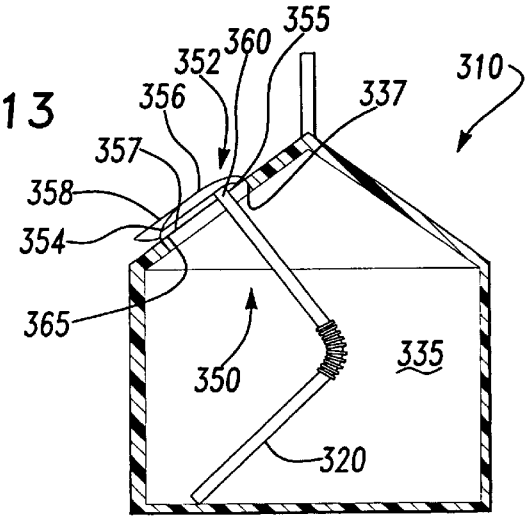
FIG. 12 is a cross-sectional view of the container illustrated in FIG. 11 taken along the line 12—12.

Another embodiment of the present invention is illustrated in FIGS. 11–14 to include a container 310 having a conduit assembly 350 with a conduit 320 (FIG. 12). Container 310 and conduit assembly 350 are illustrated in FIGS. 11 and 12 in a sealed position and in FIG. 13 in an open position. Conduit assembly 350 further includes a closure assembly 352 coupled to a fitment 354 to seal a container orifice 337 when the container is in the sealed position illustrated in FIGS. 11 and 12. Similar to the previous embodiment, the attachment of closure assembly 352 to fitment 354 can be accomplished by a scored line 365 which when separated will provide evidence of previously being opened and/or tampered with. Other means for providing tamper evidence include adhesive tape as well as other means known in the art.

As best illustrated in FIG. 12, fitment 354 includes a truncated conical base 355 that is sealably coupled to the container to encompass orifice 337 in a manner generally known in the art. Conical base 355 includes a fitment opening 357 extending therethrough to provide access to a container chamber 335. Closure assembly 352 is configured to sealably yet removably engage fitment 354 to selectively seal fitment opening 357 as illustrated in FIG. 12. Closure assembly 352 includes a cap 356 having a pry tab 358 and a post 360 extending through fitment opening 357 when cap 356 sealingly engages fitment 354. Post 360 is sized to be disposed within conduit 320 to frictionally engage the inner surface of conduit 320 thereby positioning conduit 320 relative to fitment opening 357 and couple cap 356 to conduit 320. As a result, when cap 356 is removed as discussed below, conduit 320 is drawn through opening 357 and into an operative position.

Figure 14:
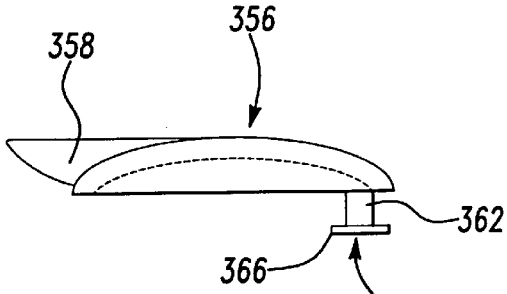
FIG. 14 is a detail of the cover illustrated in FIGS. 11–13.

As is most clearly illustrated in FIG. 14, post 360 includes a body 362 integral with cap 356 and a distal flange 366. Distal flange 366 is insertable within a first end 322 of conduit 320 whereupon the enlarged diameter of flange 366 frictionally engages the inner surface of conduit 320 to provide the above-recited benefits.

Figure 13:
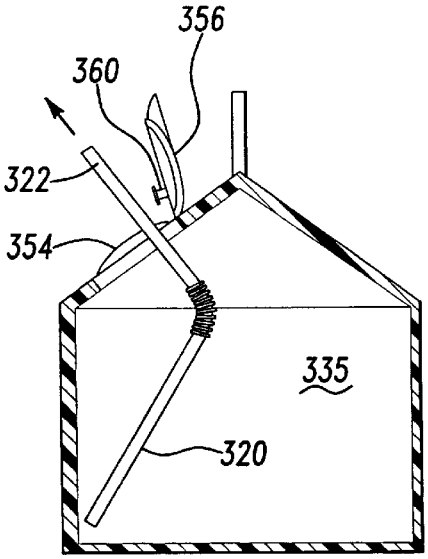
FIG. 13 is a cross-sectional view of the container illustrated in FIG. 11 in its operative position taken along the line 13—13.

When cap 356 is removed from engagement with fitment 354 as illustrated in FIG. 13, post 360 of cap 356 may be removed from first end 322 of conduit 320 thereby allowing the consumer to remove liquid from container chamber 335 via conduit 320. The configuration of cap 356 allows cap 356 to be re-snapped onto fitment 354 to re-seal container chamber 335 when desired. Those skilled in the art will also appreciate that conduit 320 may be attached to cap 356 by a tether strap coupled to corrugated segment 326 as illustrated and described above with reference to FIGS. 8A–10.

Figure 15:
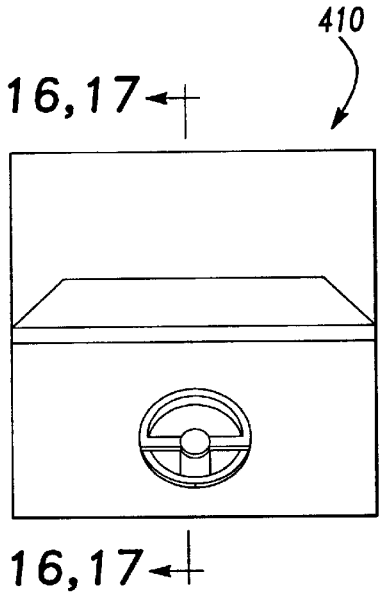
FIG. 15 is a top plan view of a container according to another embodiment of the present invention.
Figure 16:
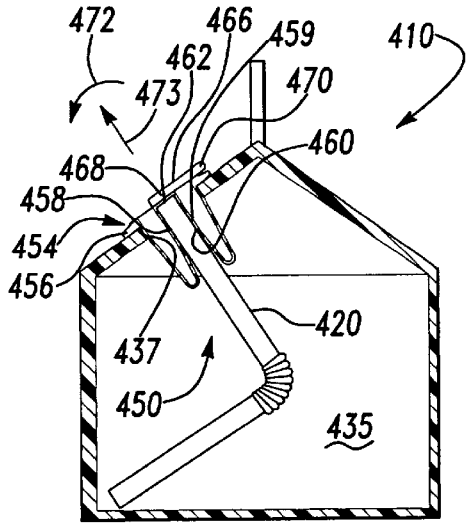
FIG. 16 is a cross-sectional view of the container illustrated in FIG. 15 in its sealed position taken along the line 16—16.
Figure 17:
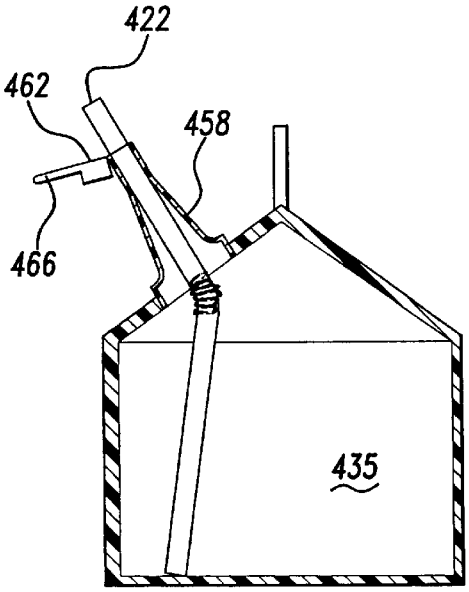
FIG. 17 is a cross-sectional view of the container illustrated in FIG. 15 in its operative position taken along the line 17—17.

Another embodiment of the present invention is illustrated in FIGS. 15–17 and includes a conduit assembly 450 that is coupled to a container 410 to seal a container chamber 435 in a sealed position illustrated in FIGS. 15 and 16, facilitate positioning of a conduit 420 relative to an orifice 437 formed in container 410, and allow the opening of conduit assembly 450 to present conduit 420 to the consumer for use. Conduit assembly 450 includes a fitment 454 that is sealably secured to container 410 to surround and seal orifice 437 when conduit assembly 450 is in its sealed position. Fitment 454 includes a seal flange 456 coupled to container 410 such as by sonic welding or other technique known in the art. A flexible sleeve 458 is formed integral with flange 456 and extends through orifice 437 into chamber 435 as shown. Sleeve 458 is generally conical in shape and is folded over upon itself to define a conduit channel 460 terminating in a cap 462. Sleeve 458 includes a scored segment 459 proximate to cap 462 in order to provide a line of weakness for severing sleeve 458 during the opening of container 410 as described below. Scored segment 459 provides evidence of container 410 being previously opened and/or tampered with.

To facilitate opening, conduit assembly 450 includes a tab ring 466 having a first end 468 integral with cap 462 and a second end 470 configured for manipulation by the consumer. More particularly, the consumer may open container 410 by rotating second end 470 of tab ring 466 in a counter-clockwise direction as indicated by arrow 472 thereby tearing sleeve 458 along scored segment 459 to expose a first end 422 of conduit 420. In the preferred embodiment, scored segment 459 does not entirely circumscribe sleeve 458. As a result, as best illustrated in FIG. 17, cap 462 remains coupled to sleeve 458 to facilitate extension of sleeve 458 after manipulation of tab 466. Specifically, displacement of tab 466 in the direction indicated by arrow 473 extends flexible sleeve 458 from the retracted position illustrated in FIG. 16 to the extended position illustrated in FIG. 17. Conduit 420 is frictionally engaged with sleeve 458 within conduit channel 460 and is thereby extended into the position illustrated in FIG. 17 whereby the consumer may extract the fluid from container chamber 435 via conduit 420.

Figure 18:
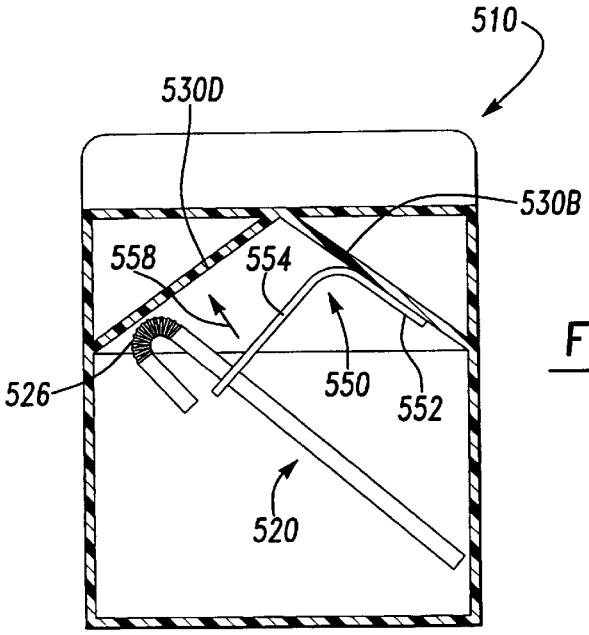
FIG. 18 is a side elevational view of another embodiment of the present invention with a side wall of the container removed for clarity.
Figure 19:
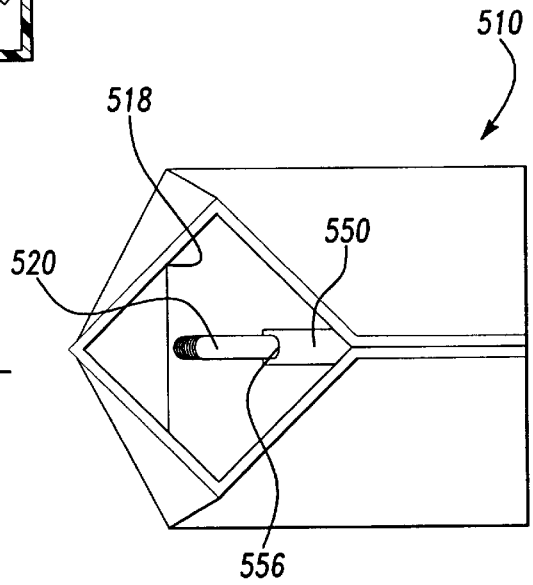
FIG. 19 is a top plan view of the container illustrated in FIG. 18 in its operative position.
Figure 20:
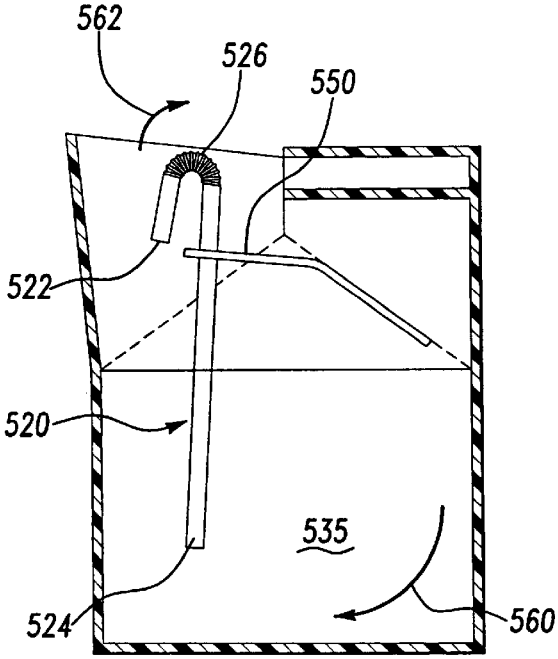
FIG. 20 is a side elevational view similar to that shown in FIG. 18 with the container and conduit in its operative position.
Figure 21:
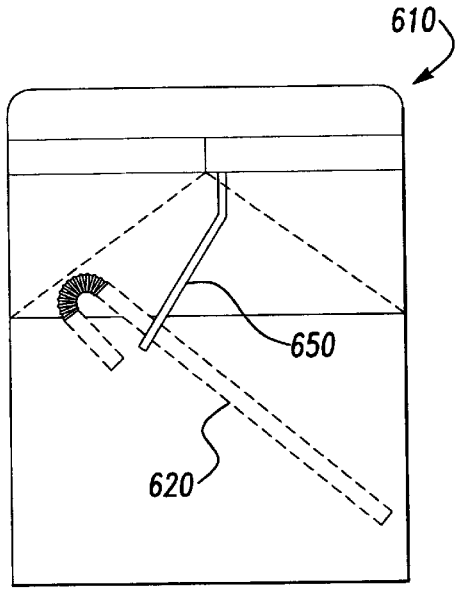
FIG. 21 is a side elevational view of a container according to another embodiment of the present invention with the container in its sealed position.
Figure 22:
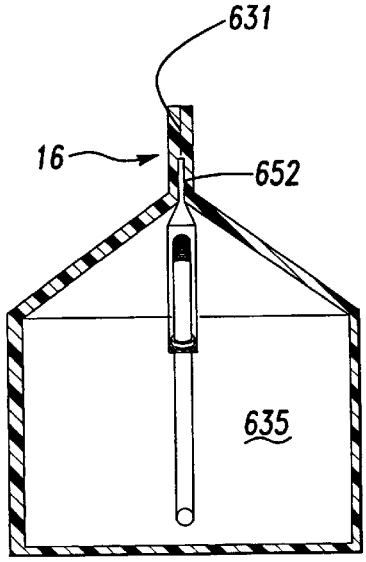
FIG. 22 is a front elevational view of the container illustrated in FIG. 21 with the front wall thereof removed for clarity.
Figure 23:
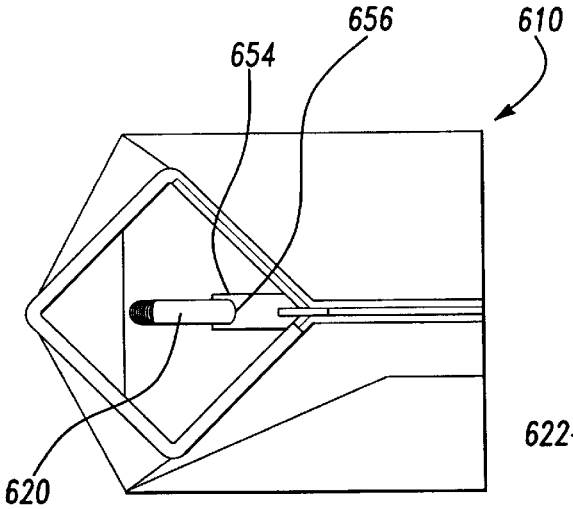
FIG. 23 is a top plan view of the container illustrated in FIG. 21 in its operative position.
Figure 24:
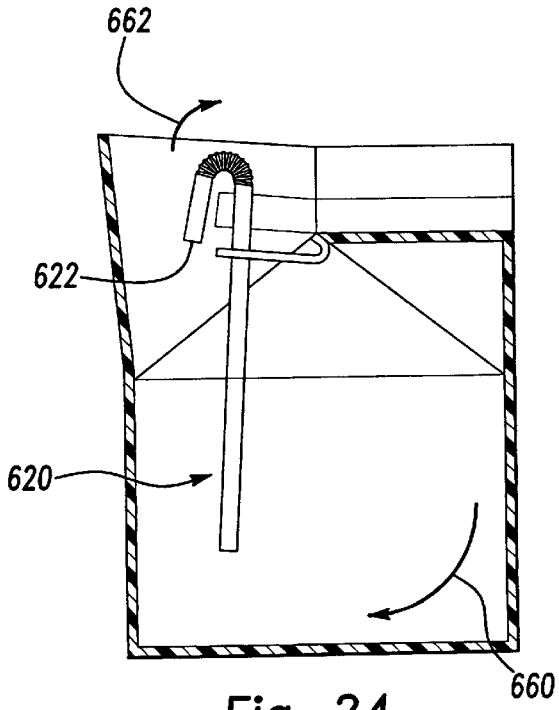
FIG. 24 is a side elevational view of the container illustrated in FIG. 23.

Additional embodiments of the present invention are illustrated in FIGS. 18–24. As illustrated, each of these embodiments generally include a straw 520, 620 disposed within a container cavity 535, 635 when a container 510, 610 is in its closed position as illustrated in FIGS. 18 and 21. With reference to FIGS. 18–20, straw 520 is coupled to container 510 via a holding strip 550 having a first segment 552 bonded to an interior back wall 530B of the container and a second segment 554 having an orifice 556 (FIG. 19) frictionally coupling straw 520 to holding strip 550. Those skilled in the art will appreciate that in the stored position illustrated in FIG. 18, holding strip 550 exerts a resilient biasing force in the direction of arrow 558 to urge a corrugated segment 526 of straw 520 against a front wall 530D for container 510. As a result, when container 510 is opened as illustrated in FIG. 19 to form diamond shaped opening 518, holding strip 550 urges straw 520 into the position illustrated in FIG. 20. More particularly, holding strip 550 urges straw 520 in a clockwise direction as indicated by arrow 560 (FIG. 20) thereby displacing a second end 524 of straw 520 from the stored position illustrated in FIG. 18 to the operative position illustrated in FIG. 20. From this position, the consumer may grasp straw 520 in the area of corrugated segment 526 and a first end 522 and urge first end 522 of straw 520 in the direction indicated by arrow 562.

A similar arrangement is illustrated in FIGS. 21–24 wherein a first end 652 (FIG. 22) of holding strip 650 is bonded to an interior side wall 631 of container 610. Those skilled in the art will appreciate that the interior side walls of the carton illustrated in FIG. 22 cooperate to form sealed crest 16 shown in FIG. 1. A second end 654 of holding strip 650 again includes an orifice 656 (FIG. 23) sized to accommodate straw 620 for frictional engagement therewith. In operation, holding strip 650 urges straw 620 in a clockwise direction 660 (FIG. 24) upon the opening of container 610. The consumer may again rotate a first end 622 of straw 620 in the clockwise direction indicated by arrow 662 to place straw 620 in its operative position. The embodiments of the present invention illustrated in FIGS. 18–24 simply yet securely maintain straws 520 and 620 in its stored position when containers 510 and 610 are in their sealed positions illustrated in FIGS. 18 and 21, respectively. Moreover, holding strips 550 and 650 effectively urge straws 520 and 620 into their operative position upon the opening of containers 510 and 610. The relative positions of the bonding of holding strips 550 and 650 to containers 510 and 610 may be selected based upon the manufacturing process used to form containers 510 and 610 to optimize efficiency and effectively reduce costs. With regard to the embodiment shown in FIGS. 21–24, bonding of holding strip 650 to interior side wall 631 for container 610 such as at crest 16 removes the presence of a bonding agent communicating with cavity 635 of container 650. Similar to the embodiment shown in FIG. 1, the embodiments shown in FIGS. 18–24 in corporate evidence of being tampered with due to the requirements of separating crest section 16 formed at the top of containers 510 and 610.

Figure 25:
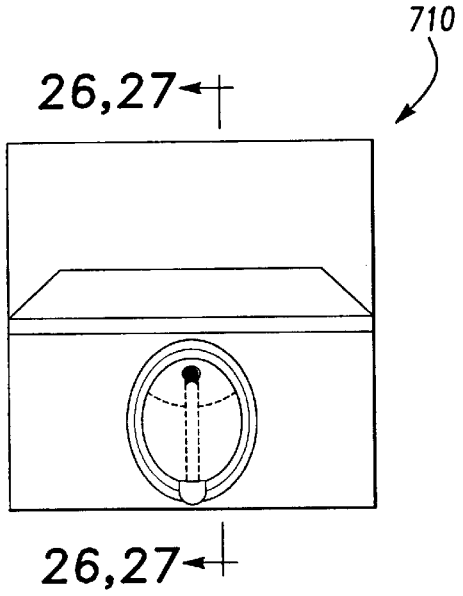
FIG. 25 is a top plan view of a container according to another embodiment of the present invention.
Figure 26:
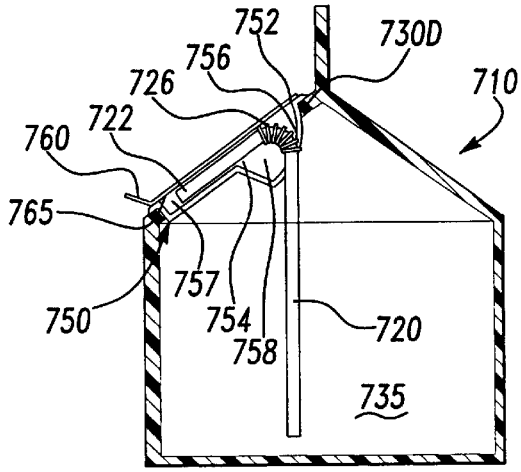
FIG. 26 is a sectional view of the container illustrated in FIG. 25 in its stored position and taken along the line 26—26.
Figure 27:
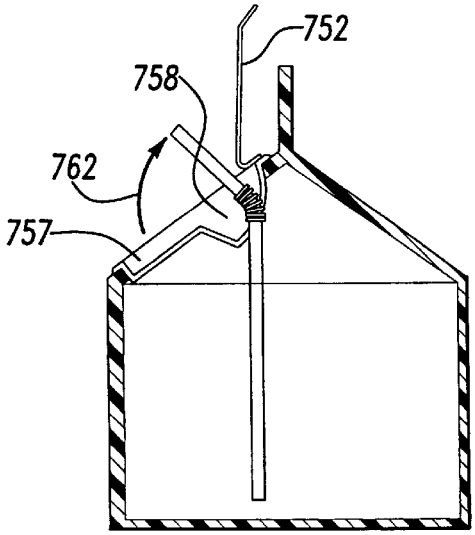
FIG. 27 is a sectional view of the container illustrated in FIG. 25 in its operative position and taken along the line 27—27.

A further embodiment of the present invention is illustrated in FIGS. 25–27 to include a fitment 750 sealably coupled to a front inclined wall 730D of a container 710. A sealing membrane 752 is coupled to and cooperates with fitment 750 to define a pocket 754 isolated from the environment surrounding container 710. Fitment 750 further defines an orifice 756 sized to accommodate a straw 720.

Pocket 754 includes a lower cavity 757 accommodating a first end 722 of straw 720 and an upper recess 758 defining a finger space for gripping straw 720 as hereinafter described. Sealing membrane 752 includes a tab 760 that can be grasped by the consumer to peel the sealing membrane from fitment 750 in the direction illustrated by arrow 762 (FIG. 27). Finger space 758 provides an additional cavity whereby the consumer can grasp straw 720 proximate to a corrugated segment 726 thereof in order to urge straw 720 into the operating position illustrate in FIG. 27. Those skilled in the art will appreciate that fitment 750 and sealing membrane 752 cooperate to isolate the contents of the container within a chamber 735 and maintain straw 720 in a secure position relative thereto when container 710 is in its stored position illustrated in FIGS. 25 and 26. Moreover, after sealing membrane 752 is peeled from fitment 750, the consumer may manipulate straw 720 such as by bending or elongation to locate straw 720 in the desired position for drinking the fluid. The attachment between sealing membrane 752 and fitment 750 can be a scored line which when separated will provide evidence of previously being opened and/or tampered with. Other means for providing tamper evidence include adhesive tape or other means known well in the art.

Figure 28:
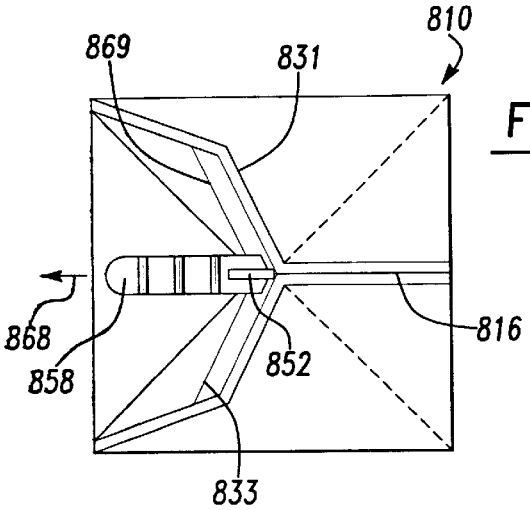
FIG. 28 is a top plan view of a container according to another embodiment of the present invention in its partially open condition.
Figure 29:
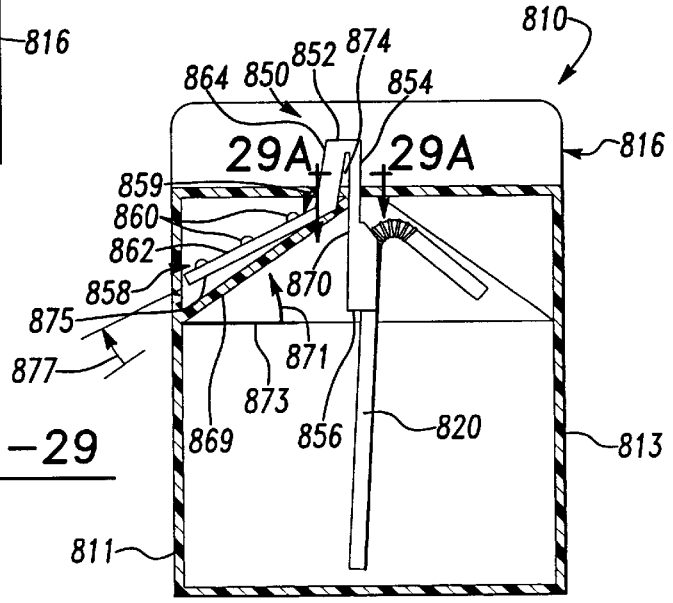
FIG. 29 is a side elevational view of the container illustrated in FIG. 28 in its sealed position with a side wall removed for clarity.
Figure 30:
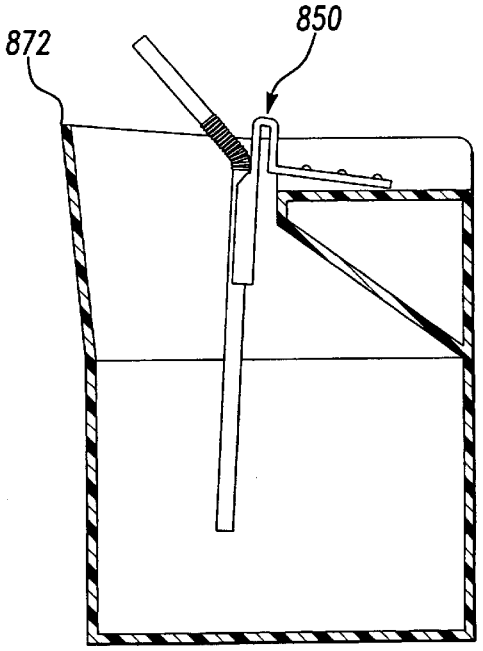
FIG. 30 is a side elevational view of the container illustrated in FIG. 28 in its operative position with a side wall thereof removed for clarity.
Figure 31:
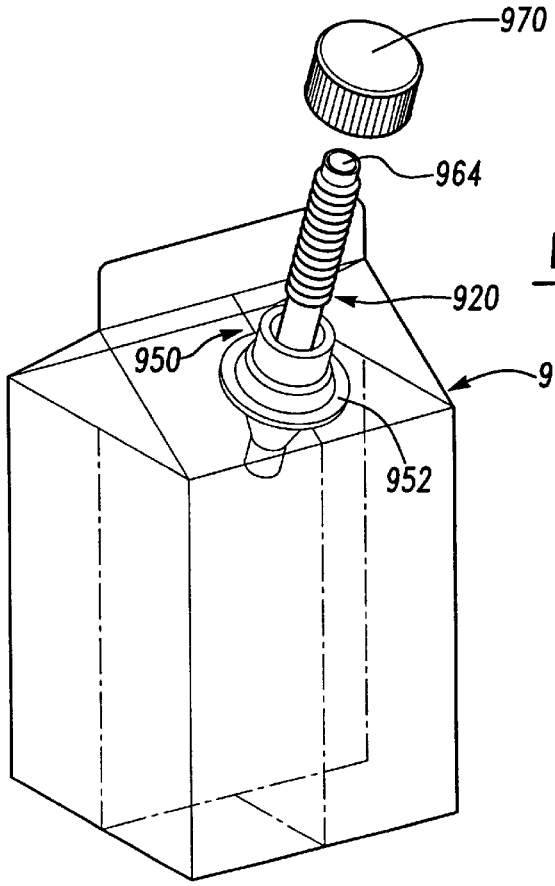
FIG. 31 is a perspective view of a container according to another embodiment of the present invention.

Still another embodiment of the present invention is illustrated in FIGS. 28–30 to include a container 810 having a front side 811 and a rear side 813. A straw retention apparatus 850 is included with container 810 to facilitate opening of container 810 and positioning of a straw 820 from the stored position illustrated in FIG. 29 to the operative position illustrated in FIG. 30.

Figure 29A:
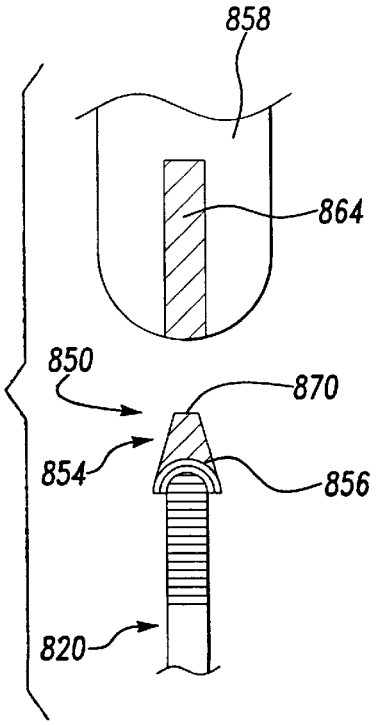
FIG. 29A is a sectional view taken along the line 29A—29A illustrated in FIG. 29.

Apparatus 850 includes a rectangular upper surface 852 integral with a downwardly extending straw coupler 854 that defines a generally semi-circular channel 856 (FIG. 29A) configured to cooperatively engage straw 820 in a snap-fit engagement. This snap-fit engagement couples straw 820 to apparatus 850 for manipulation as described below. Apparatus 850 also includes an inclined tab 858 having a plurality of treads 860 extending from an upper face 862 thereof. Tab 858 is integral with a post 864 which in turn is integral with upper surface 852. In the preferred embodiment, tab 858 is disposed at an angle 859 relative to post 864 that is preferably greater than 90°, more preferably within the range of 90° to 135°, and even more preferably at an angle of 120° to 125°. Those skilled in the art will appreciate that the preferred magnitude of angle 859 is dependent upon an angle 871 of a surface 869 relative to a horizontal 873. In the preferred embodiment, angle 871 is approximately 45° such that when angle 859 is 120° to 125°, a bottom surface 875 of tab 858 forms an angle 877 of 10° to 15° from surface 869.

Those skilled in the art will appreciate from the illustrations and the following description that apparatus 850 facilitates the opening of container 810. More particularly, the opening of container 810 is initiated by displacing tabs 831 and 833 (FIG. 28) away from one another thereby breaking the seal along a crest 816. After placing tabs 831 and 833 in the positions illustrated in FIG. 28, the consumer can further open container 810 by displacing apparatus tab 858 in the direction of arrow 868 (FIG. 28). Straw coupler 854 includes a wedge surface 870 that, during the movement of tab 858 in the direction of arrow 868, engages a folded apex 872 (FIG. 30) of container 810 and urges apex 872 in the direction of arrow 868 thereby extending the flaps along a line 869 (FIGS. 28 and 29) to the open position shown in FIG. 30. As a result, apparatus 850 provides a device that facilitates the opening of container 810.

After the opening of container 810, apparatus 850 may be repositioned relative to the opening as illustrated in FIG. 30 to locate straw 820 in its operative position. More particularly, apparatus 850 defines a coupling cavity 874 sized to accommodate one of flaps 831 or 833 for container 810 to coupled straw 820 thereto. While the above-described embodiments of the present invention include a conduit illustrated as straw 820, those skilled in the art will appreciate that a variety of conduits may be used with the present invention without departing from the proper scope thereof as defined by the appended claims. More particularly, as illustrated in FIGS. 31–34, the conduit may include a pour spout 920 coupled to the container 910 for movement between a stored position illustrated in FIG. 33 and an operative position illustrated in FIG. 34.

Figure 32:
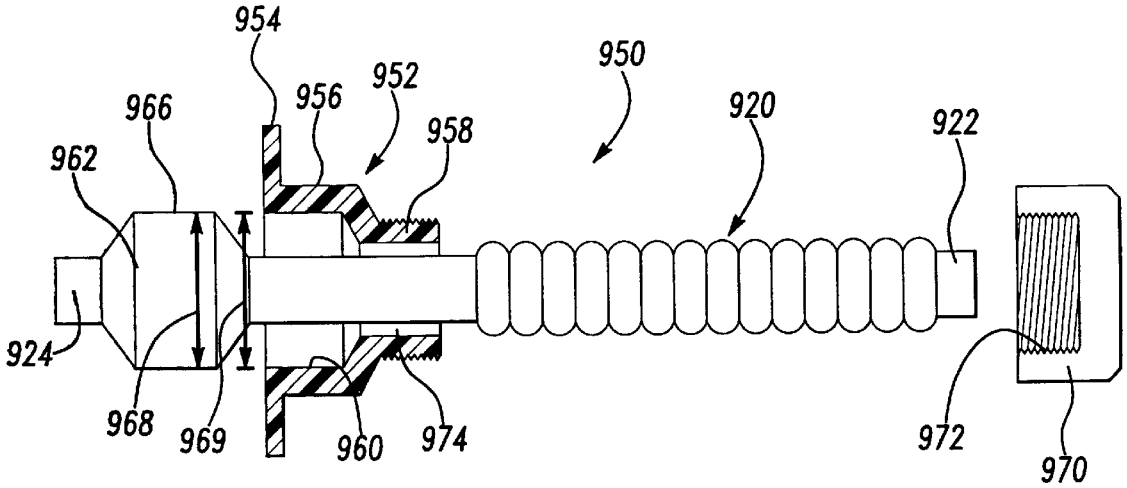
FIG. 32 is a partial cross-sectional view of the fitment and spout configuration illustrated in FIG. 31.
Figure 33:
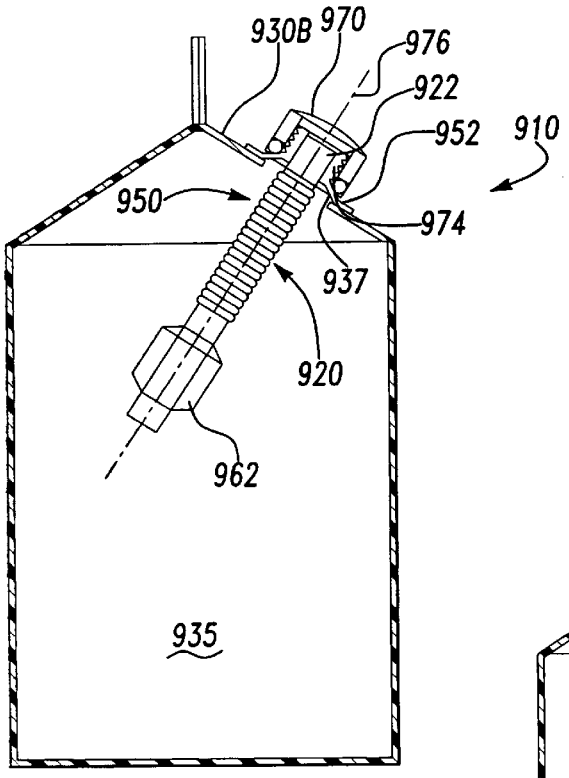
FIG. 33 is a side elevational view of the container illustrated in FIG. 31 in its stored position with a side wall of the container removed for clarity.
Figure 34:
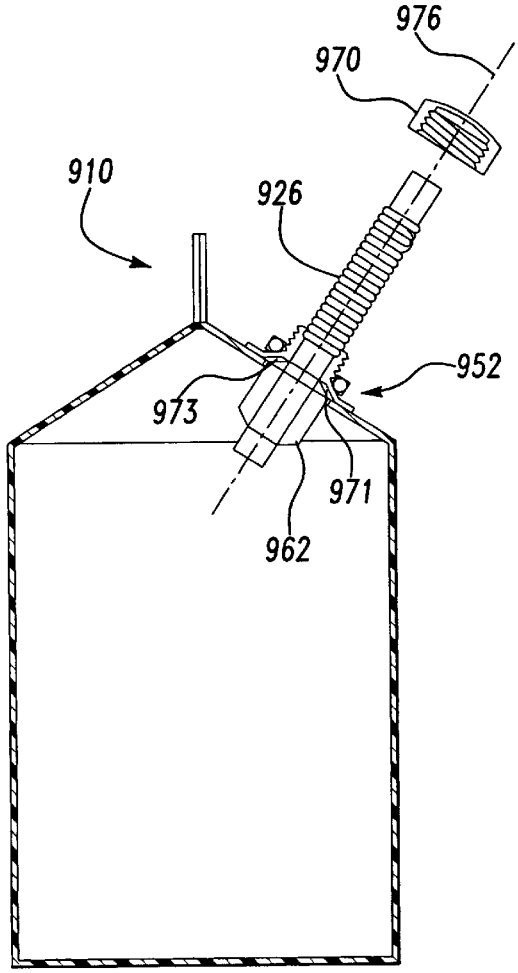
FIG. 34 is a side elevational view of the container illustrated in FIG. 31 in its operative position with a side wall of the container removed for clarity.

Referring to FIGS. 31–35, a container 910 includes an inclined front wall 930B that defines an orifice 937 configured to accommodate a conduit assembly 950 that includes a fitment 952 sealably coupled to wall 930B in a manner generally known in the art (FIG. 33). As will be appreciated from the following description, fitment 952 is configured to cooperate with a sealing member 962 on spout 920. A variety of configurations for this sealing interaction between fitment 952 and spout 920 may be provided by one skilled in the art without departing from the scope of the invention as defined by the appended claims. In the interest of completeness, one embodiment of the sealing interaction is illustrated in FIG. 32 while an alternate configuration is shown in FIGS. 33 and 34. In FIG. 32, fitment 952 is shown to include a flange section 954, a sleeve 956 and a threaded axial projection 958. Sleeve 956 includes a generally cylindrical inner surface 960 sized to sealably accommodate sealing member 962 formed proximate to a second end 924 of spout 920. Those skilled in the art will appreciate that spout 920 defines a continuous cylindrical passage 964 (FIG. 31) extending between first and second spout ends 922 and 924. Sealing member 962 of spout 920 defines a radial seal face 966 slightly larger in diameter 968 than a diameter 969 of inner surface 960 of sleeve 956. Sealing member 962 is preferably formed of a resilient material having a density less than that of the fluid contained within container 910 so that sealing member 962 creates a buoyant force urging spout 920 toward its operative position illustrated in FIG. 34. Conduit assembly 950 also includes a cap 970 having internal threads 972 sized to cooperate with the threads on projection 958.

Conduit assembly 950 is illustrated in FIG. 33 with spout 920 thereof in its stored position and in FIG. 34 in its operative position. In FIGS. 33 and 34, the sealing engagement between sealing member 962 and fitment 952 occurs along cooperating inclined surfaces 971 and 973 on fitment 952 and sealing member 962, respectively. As noted above, various other configurations of sealing member 962 and/or fitment 952 is within the general knowledge of one skilled in the art.

With respect to the stored position illustrated in FIG. 33, first end 922 of spout 920 is coupled to cap 970 and/or fitment 952 such as by a tether (not shown) or other mechanism generally described with reference to FIGS. 1–30. As a result, first end 922 of spout 920 is maintained within a recess 974 formed by fitment 952 thereby properly aligning spout 920 within fitment 952 for movement from its stored position to its operative position. More particularly, spout 920 is moved to its operative position illustrated in FIG. 34 by removing cap 970 from fitment 952 whereupon the buoyant force of sealing member 962 urges spout 920 along an axis 976 toward the operative position. Those skilled in the art will appreciate that the tether, sealing membrane, or other mechanism used to couple the spout to the fitment may be removed by the consumer thereby allowing movement of the spout relative to fitment 952. The attachment between cap 970 and fitment 952 can be a scored line (not shown) which when separated will provide evidence of previously being opened and/or tampered with. Other means for providing tamper evidence include adhesive tape, a break away ring or other means known in the art.

In its operative position, sealing member 962 of spout 920 sealably engages inner surface 960 of sleeve 956 (FIG. 32) to prevent leakage through fitment 952 when the liquid is poured from a container cavity 935. It should be appreciated that the sealing engagement between sealing member 962 and sleeve 956 may be facilitated by the buoyant force of sealing member 962 and enhanced by the consumer exerting an axial force upon spout 920 to securely and sealably engage sealing member 962 and sleeve 956. Spout 920 again includes a corrugated segment 926 (FIG. 31) to facilitate proper positioning of the spout for dispensation of the liquid.

With reference to FIGS. 1–27 and, more particularly, to FIGS. 6–17, those skilled in the art will appreciate that the variety of fitment configurations illustrated in these drawings may be modified to include a fitment configuration, such as that illustrated in FIG. 32, to sealably engage a spout to facilitate pouring of the liquid from the container rather than retraction through a straw. More particularly, the fitment illustrated in each of these drawings may be modified to include a sleeve extending either into or out of the container chamber to sealably engage a spout sealing member such as 962.

Figure 35:
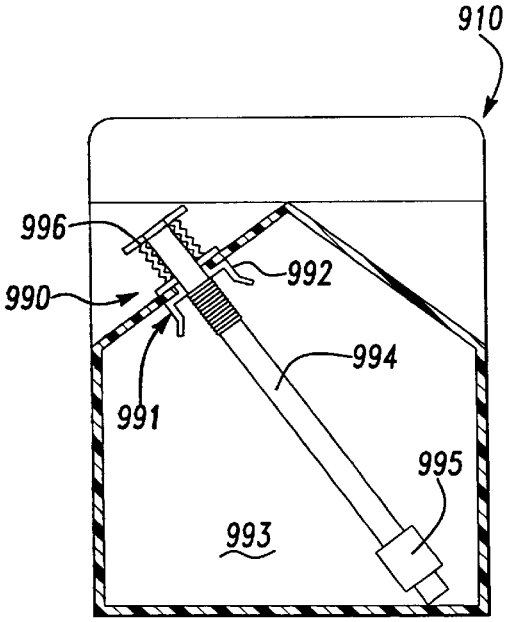
FIG. 35 is a side elevational view of a container according to another embodiment of the present invention with a side wall of the container removed for clarity.

For completeness, FIG. 35 illustrates such a fitment assembly for the embodiment of the present invention illustrated in FIGS. 5–7. More particularly, container 910 includes a conduit assembly 990 substantially similar to that illustrated and described with reference to FIGS. 5–7. Conduit assembly 990 includes a fitment 991 having a sealing sleeve 992 extending inwardly into a cavity 993. A spout 994 includes a sealing member 995 configured to sealably engage sleeve 992 when spout 994 is in its operative position. As illustrated, conduit assembly 990 includes a plunger 996 for positioning spout 994 in its operative position as described above. In view of the above description, it will be appreciated by those skilled in the art that fitment 991 is substantially the same as that illustrated in FIGS. 5–7 with the exception of the addition of inwardly protruding axial sleeve 992 similar in configuration and function to sleeve 956 illustrated and described above.

In view of the above alternative embodiment, those skilled in the art will appreciate that a variety of alternate embodiments in conjunction with this description and the appended drawings are within the general knowledge of those skilled in the art and therefore within the scope of the invention as defined by the appended claims. More particularly, one skilled in the art will appreciate that an inwardly protruding axial conical sleeve of the type described above and referenced by numeral 992 may be employed with any of the foregoing embodiments. It is anticipated that such an inwardly protruding sleeve facilitates manipulation of the device to urge the conduit through the container orifice.

Figure 36:
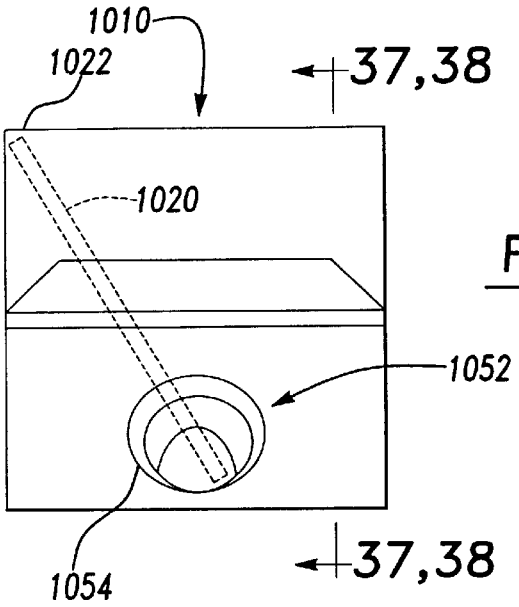
FIG. 36 is a top plan view of a container according to another embodiment of the present invention.
Figure 37:
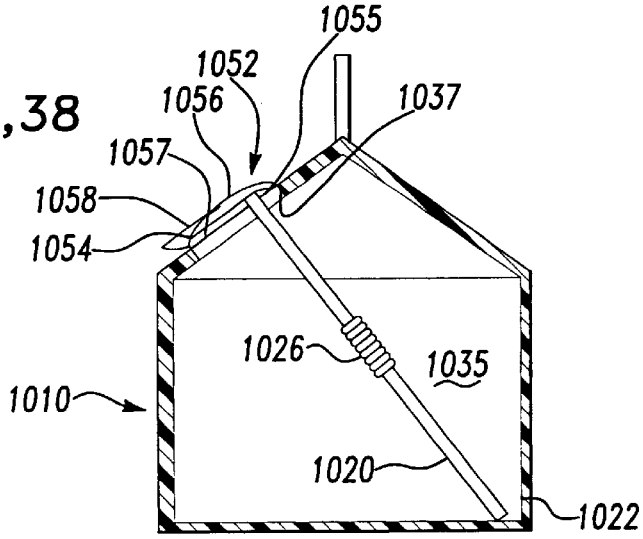
FIG. 37 is a cross-sectional view of the container illustrated in FIG. 36 taken along the line 37—37.

Referring now to FIGS. 36–39, another embodiment of the present invention is disclosed. A container 1010 defines an internal chamber 1035 within which is disposed a conduit 1020. Container 1010 and conduit 1020 are illustrated in FIGS. 36 and 37 in a sealed position and in FIG. 38 in an unsealed or open position. Conduit 1020 is disposed within chamber 1035 of container 1010 when in the sealed condition and conduit 1020 extends from a lower comer 1022 of container 1010 to a fitment 1054. Conduit 1020 includes a pleated or corrugated section 1026 which is extendably by the consumer for removal of fluid within chamber 1035.

Fitment 1054 includes a closure assembly 1052 and a base 1055. Base 1055 is sealingly coupled to container 1010 to encompass an orifice 1037 extending through container 1010 in a manner generally known in the art. Base 1055 includes a fitment opening 1057 extending therethrough to provide access to chamber 1035. Closure assembly 1052 is configured to sealably yet removably engage fitment 1054 to selectively seal fitment opening 1057 as illustrated in FIG. 37. Closure assembly 1052 includes a cap 1056 having an externally located pry tab 1058 and an internally located contoured surface 1060. The collapsed length of conduit 1020 is designed such that when container 1010 is sealed, conduit 1020 is trapped between lower corner 1022 of container 1010 and contoured surface 1060 as shown in FIGS. 36 and 37. The attachment between cap 1056 and 1055 can be a scored line (not shown) which when separated will provide evidence of previously being opened or tampered with. Other mans for providing tamper evidence include adhesive tape or other means known in the art.

Figure 38:
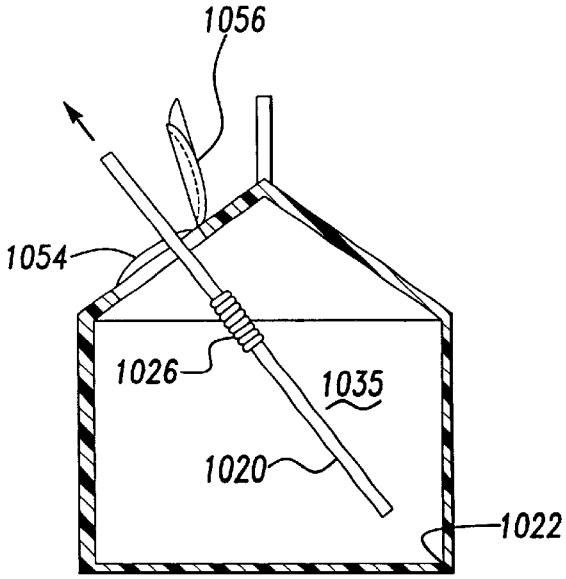
FIG. 38 is a cross-sectional view of the container illustrated in FIG. 36 in its operative position taken along the line 38—38.
Figure 39:
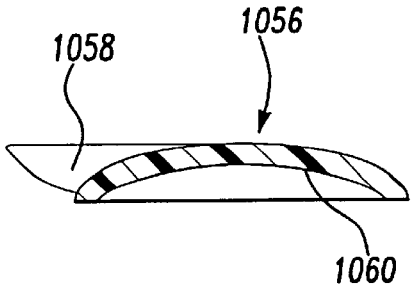
FIG. 39 is a detail of the cover illustrated in FIGS. 36–38.

When cap 1056 is removed from engagement with base 1055, as illustrated in FIG. 38, conduit 1020 extends through fitment opening 1057 due to the buoyant nature of conduit 1020. If desired, a float (not shown) may be attached to conduit 1020 to improve its buoyant characteristics.

Figure 40:
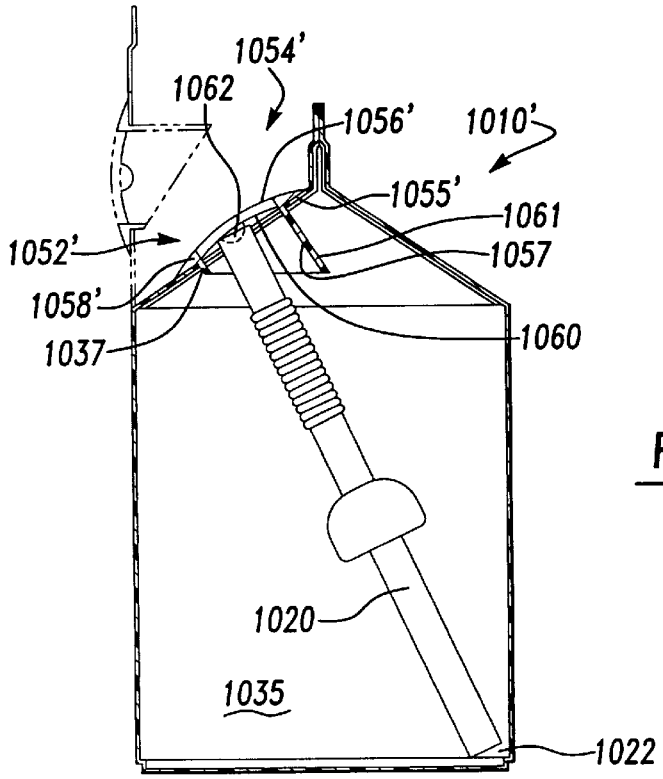
FIG. 40 is a cross-sectional view of a container according to another embodiment of the present invention.

Referring to FIG. 40, another embodiment of the present invention is disclosed. FIG. 40 is a view similar to FIG. 37. A container 1010' defines internal chamber 1035 within which is disposed conduit 1020. Conduit 1020 is disposed within chamber 1035 of container 1010' when in the sealed condition and conduit 1020 extends from lower comer 1022 of container 1010' to a fitment 1054'.

Fitment 1054' includes a closure assembly 1052' and a base 1055'. Base 1055' is sealingly coupled to container 1010' to encompass orifice 1037. Base 1055' includes fitment opening 1057 extending therethrough to provide access to chamber 1035. Closure assembly 1052' is configured to sealingly yet removably engage fitment 1054' to selectively seal fitment opening 1057 as illustrated in FIG. 40. Closure assembly 1052' includes a cap 1056' having externally located pry tab 1058, internally located contoured surface 1060, a skirt 1061 and a post 1062. The collapsed length of conduit 1020 is designed such that when container 1010' is sealed, conduit 1020 is trapped between lower comer 1022 of container 1010' and contoured surface 1060 of cap 1056' as shown in FIG. 40. Skirt 1061 and post 1062 held to maintain the position of conduit 1020. Skirt 1061 surrounds conduit 1020 while post 1062 extends into conduit 1020. The attachment between cap 1056' and base 1058' can be a scored line (not shown) which when separated will provide evidence of previously being opened and/or tampered with. Other means for providing tamper evidence include adhesive tape or other means known in the art.

When cap 1056' is removed from engagement with base 1055', as illustrated in phantom in FIG. 40, conduit 1020 will extend through fitment opening 1057 similar to that shown in FIG. 38.

Figure 41:
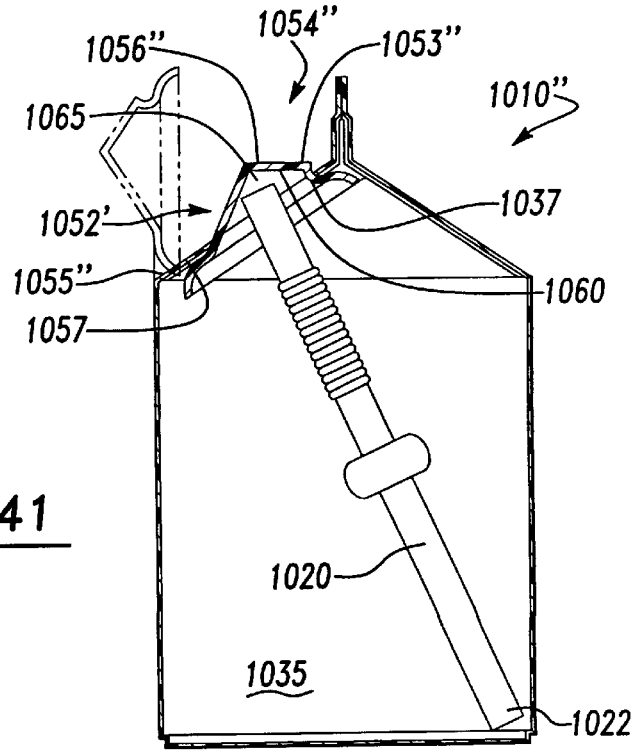
FIG. 41 is a cross-sectional view of a container according to another embodiment of the present invention.

Referring now to FIG. 41, another embodiment of the present invention is disclosed. FIG. 41 is a view similar to FIG. 37. A container 1010" defines interior chamber 1035 within which is disposed conduit 1020. Conduit 1020 is disposed within chamber 1035 of container 1010" when in the sealed condition and conduit 1020 extends from lower corner 1022 of container 1010 to a fitment 1054". Conduit 1020 is positioned within chamber 1035 by applying tension to conduit 1020 which will bend it from its normal position, thus holding it fast within container 1010".

Fitment 1054" includes a closure assembly 1052" and a base 1055". Base 1055" is sealingly coupled to encompass orifice 1037 extending through container 1010" in a manner generally known in the art. Base 1055" includes fitment opening 1057 extending therethrough to provide access to chamber 1035. Closure assembly 1052" is configured to sealably yet removably engage fitment 1054" to selectively seal fitment opening 1057 as illustrated in FIG. 41. Closure assembly 1052" includes a cap 1056" having an externally located pry tab 1058" and an internally located contoured surface 1060" which defines a chamber 1065. The collapsed length of conduit 1020 is designed such that when container 1010" is sealed, conduit 1020 is trapped between lower corner 1022 of container 1010" and contoured surface 1060" with the upper end of conduit 1020 being located within chamber 1065 as shown in FIG. 41. Conduit 1020 is positioned within chamber 1035 by applying tension to conduit 1020 which will bend it from its normal position, thus holding it fast within container 1010". The attachment between cap 1056" and base 1055" can be a scored line (not shown) which when separated will provide evidence of previously being opened and/or tampered with. Other means for providing tamper evidence include adhesive tape or other means known in the art.

When cap 1056" is removed from engagement with base 1055" as illustrated in phantom in FIG. 41, conduit 1020 extends through fitment opening 1057 similar to that shown in FIG. 38.

Figure 42:
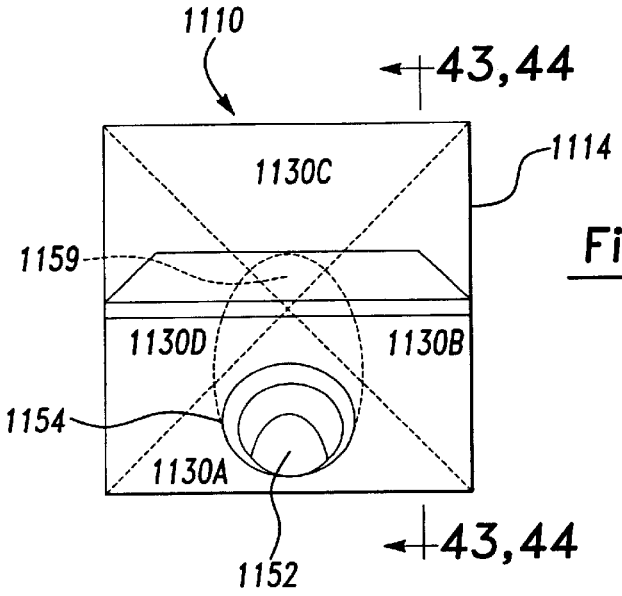
FIG. 42 is a top plan view of a container according to another embodiment of the present invention.
Figure 43:
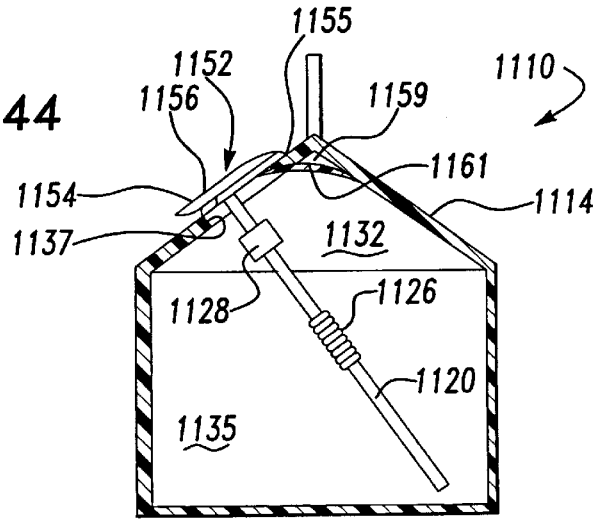
FIG. 43 is a cross-sectional view of the container illustrated in FIG. 42 taken along the line 43—43.

Referring now to FIGS. 42–45, another embodiment of the present invention is disclosed. A container 1110 defines an internal chamber 1135 within which is disposed a conduit 1120. Container 1110 and conduit 1120 are illustrated in FIGS. 42 and 43 in a sealed position and in FIG. 44 in an unsealed or open position. Container 1110, in its unopened or sealed condition as illustrated in FIG. 42 forms a gable top 1114 which includes four planar and triangular shaped sections 1130A, 1130B, 1130C, and 1130D which form a pyramid shaped gable cavity 1132 within container 1110. Conduit 1120 is disposed within chamber 1135 of container 1110 when in the sealed condition and conduit 1120 is free to move within chamber 1135. Conduit 1120 includes a pleated or corrugated section 1126 and a float 1128. Corrugated section 1126 is extendable by the consumer for removal of fluid from chamber 1135 while float 1128 provides buoyancy to conduit 1120 to urge conduit 1120 against the upper portion of container 1110.

A fitment 1154 includes a closure assembly 1152 and a base 1155. Base 1155 is sealingly coupled to container 1110 to encompass an orifice 1137 extending through container 1110 in a manner generally known in the art. Base 1155 includes a fitment opening 1157 extending therethrough to provide access to chamber 1135. Base 1155 also includes an extension 1159 which mates with the point formed by sections 1130A, 1130B, 1130C and 1130D within gable cavity 1132. Extension 1159 includes a contoured surface 1161 which directs or guides conduit 1120 towards fitment opening 1157. Conduit 1120 is urged against contoured surface 161 by its buoyancy as well as the buoyance of float 1128. The shape of contoured surface 1161 is designed to direct or guide conduit 1120 into fitment opening 1157.

Closure assembly 1152 is configured to sealably yet removably engage fitment 1154 to selectively seal fitment opening 1157 as illustrated in FIG. 43. Closure assembly 1152 includes a cap 1156 having an externally located pry tab 1158 and an internally located contoured surface 1160. As conduit 1120 is guided towards fitment opening 1157, it extends partially through opening 1157 to contact contoured surface 1160. Conduit surface 1160 is designed to trap conduit 1120 within opening 1157 due to the buoyance of conduit 1120 and float 1128 such that it is readily available when container 1110 is opened by removing cap 1156. The attachment between cap 1156 and base 1155 can be a scored line (not shown) which when separated will provide evidence of previously being opened and/or tampered with. Other means for providing tamper evidence include adhesive tape or other means known in the art.

Figure 44:
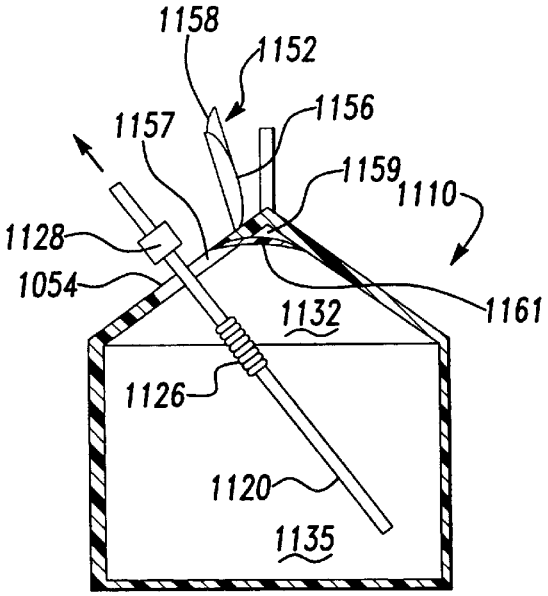
FIG. 44 is a cross-sectional view of the container illustrated in FIG. 42 in its operative position taken along the line 44—44.
Figure 45:
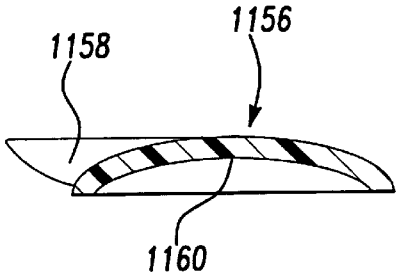
FIG. 45 is a detail of the cover illustrated in FIGS. 42–44.

When cap 1156 is removed from engagement with base 1155, as illustrated in FIG. 44, conduit 1120 extend through fitment 1157 due to the buoyant nature of conduit 1120 and float 1128. Conduit 1120 is positioned against contoured surface 1160 of cap 1156 due to the interaction with contoured surface 1161 of base 1055.

In another embodiment of the invention, conduit 1120 is not free to move within chamber 1135. Instead, conduit 1120 extends from a lower corner of container 1110 to closure assembly 1152 in a manner similar to that shown above in FIGS. 36–39, 40 and 41.

Various other advantages and modifications will become apparent to one skilled in the art after having the benefit of studying the teachings of the specification, the drawings and the following claims.

What is claimed is:

1. A conduit assembly comprising:

a fitment adapted to be sealingly coupled to a container, said fitment defining a fitment passage;

a closure mechanism movable between a sealed position and an open position, said closure mechanism sealingly engaging said fitment to seal said fitment passage when said closure mechanism is in said sealed position;

said closure mechanism including a plunger having a head coupled to a collapsible sleeve, said collapsible sleeve sealingly coupled to said fitment about said fitment passage, said head defining an opening, said closure mechanism further including a seal member sealing said opening when said closure mechanism is in said sealed position; and a conduit operably associated with said closure mechanism for movement between a stored position and an operative position, said conduit being moved from said stored position toward said operative position when said closure mechanism is moved between said sealed position and said open position.

2. The conduit assembly of claim 1 wherein said conduit has a first end disposed within said collapsible sleeve when said closure mechanism is in said sealed position.

3. The conduit assembly of claim 2 further including a float coupled to said conduit.

4. The conduit assembly of claim 2 wherein said first end of said conduit extends through said opening when said conduit is in said operative position.

5. An apparatus for opening a container comprising:

a tab having a grip surface;

a post integral with said tab and extending upwardly therefrom to define a length of said post; and a wedge integral with said post, said wedge extending along the entire length of said post to a position below said post.

6. The apparatus of claim 5 wherein said tab and said post define an angle greater than 90°.

7. The apparatus of claim 6 wherein said angle is in the range of 90° to 135°.

8. The apparatus of claim 5 further including a member interconnecting said post and said wedge, wherein said wedge is separated from said post to define a blind slot extending downwardly from said member.

9. The apparatus of claim 8 wherein said wedge includes a conduit channel adapted to couple a conduit to said wedge.

10. An apparatus for opening a container comprising:

a tab having a grip surface;

a post integral with said tab and extending upwardly therefrom;

a wedge integral with said post, said wedge extending below said post; and a member interconnecting said post and said wedge, said wedge being separated from said post to define a blind slot extending downwardly from said member.

11. The apparatus of claim 10 wherein said wedge includes a conduit channel adapted to couple a conduit to said wedge.

* * * * *